US010188208B2

(12) United States Patent
Goetz

(10) Patent No.: US 10,188,208 B2
(45) Date of Patent: Jan. 29, 2019

(54) DRIVE MECHANISM FOR A MOVABLE FURNITURE PART

(71) Applicant: Julius Blum GmbH, Hoechst (AT)

(72) Inventor: Christof Goetz, Lustenau (AT)

(73) Assignee: Julius Blum GmbH, Hoechst (AT)

( * ) Notice: Subject to any disclaimer, the term of this patent is extended or adjusted under 35 U.S.C. 154(b) by 175 days.

(21) Appl. No.: 15/367,624

(22) Filed: Dec. 2, 2016

(65) Prior Publication Data

US 2017/0079430 A1 Mar. 23, 2017

Related U.S. Application Data

(63) Continuation of application No. PCT/AT2015/000063, filed on May 4, 2015.

(30) Foreign Application Priority Data

Jun. 6, 2014 (AT) ..... A 450/2014

(51) Int. Cl.

| | |
|---|---|
| ***A47B 88/47*** | (2017.01) |
| ***A47B 88/46*** | (2017.01) |
| ***A47B 88/477*** | (2017.01) |
| ***A47B 88/467*** | (2017.01) |
| ***A47B 88/463*** | (2017.01) |

(52) U.S. Cl.

CPC ..... *A47B 88/477* (2017.01); *A47B 88/463* (2017.01); *A47B 88/467* (2017.01)

(58) Field of Classification Search

CPC ... A47B 88/40; A47B 88/463; A47B 88/0477; A47B 88/467; A47B 88/047; A47B 88/47; A47B 88/0481; A47B 88/473; A47B 88/477

See application file for complete search history.

(56) References Cited

U.S. PATENT DOCUMENTS

| | | | | |
|---|---|---|---|---|
| 7,374,260 | B2 * | 5/2008 | Lu | A47B 88/467 312/319.1 |
| 7,481,505 | B2 | 1/2009 | Orita | |
| 8,632,142 | B2 * | 1/2014 | Park | A47B 88/467 312/333 |
| 9,204,721 | B2 * | 12/2015 | Gasser | A47B 88/04 |
| 2007/0114896 | A1 | 5/2007 | Orita | |

(Continued)

FOREIGN PATENT DOCUMENTS

| | | |
|---|---|---|
| DE | 20 2007 006 825 | 10/2008 |
| DE | 20 2009 005 009 | 4/2010 |

(Continued)

OTHER PUBLICATIONS

EP2281482 Translated Description, 7 pages (Year: 2011).*

(Continued)

*Primary Examiner* — Andrew M Roersma
(74) *Attorney, Agent, or Firm* — Wenderoth, Lind & Ponack, L.L.P.

(57) ABSTRACT

A drive mechanism for a movable furniture part includes a mechanically loaded drive element which is movable in the drive direction. The drive element has a drive stop by which a follower can be moved in the course of a drive movement. On a side of the drive element facing away from the drive stop, a ramp is provided to allow the follower to pass over the drive element in the drive direction.

25 Claims, 18 Drawing Sheets

(56) References Cited

U.S. PATENT DOCUMENTS

| | | | | |
|---|---|---|---|---|
| 2011/0175508 | A1 | 7/2011 | Rechberg et al. | |
| 2013/0076219 | A1* | 3/2013 | Lam | A47B 88/14 312/319.1 |
| 2014/0021841 | A1* | 1/2014 | Brunnmayr | A47B 88/0477 312/319.1 |

FOREIGN PATENT DOCUMENTS

| | | | | |
|---|---|---|---|---|
| DE | 20 2009 005 121 | | 2/2011 | |
| DE | 202010000479 | U1 * | 8/2011 | A47B 88/463 |
| EP | 2 281 482 | | 2/2011 | |
| EP | 2526825 | A1 * | 11/2012 | A47B 88/467 |
| JP | 2002-106238 | | 4/2002 | |
| JP | 2007-160079 | | 6/2007 | |
| TW | M472452 | | 2/2014 | |
| TW | M474401 | | 3/2014 | |
| TW | M477828 | | 5/2014 | |
| WO | WO-2006097413 | A1 * | 9/2006 | A47B 88/467 |
| WO | WO-2010149568 | A1 * | 12/2010 | A47B 88/467 |
| WO | WO-2012149587 | A1 * | 11/2012 | A47B 88/463 |
| WO | WO-2013120119 | A1 * | 8/2013 | A47B 88/04 |
| WO | 2014/056759 | | 4/2014 | |

OTHER PUBLICATIONS

JP2002106238 Translated Description, 9 pages (Year: 2002).*
DE202007006825 Translated Description, 7 pages (Year: 2008).*
TWM472452 Bib Sheet, 1 page (Year: 2014).*
International Search Report dated Jul. 23, 2015 in International (PCT) Application No. PCT/AT2015/000063.
Search Report dated Mar. 23, 2015 in Austrian Application No. A 450/2014, with English translation.

* cited by examiner

DRIVE MECHANISM FOR A MOVABLE FURNITURE PART

BACKGROUND OF THE INVENTION

The invention concerns a drive device for a movable furniture part, comprising a force-actuated drive element which is movable in a drive movement direction. The drive element has a drive limit stop by which an entrainment member can be moved in the course of a drive movement. Moreover, the invention concerns an arrangement comprising a drawer extension guide and such a drive device. Further, the invention concerns an item of furniture with a furniture carcass, a movable furniture part and such a drive device.

With furniture fittings, in particular with drive devices, it is usually necessary that drive movements are transmitted between individual components. As this transmission should mostly happen only section-wise during a relative movement of a movable furniture part to the drive device, this is effected for example by an appropriate mechanical coupling. Therefore, in the case of drive devices according to the state of the art, entrainment members are used in connection with limit stops formed on drive elements. In the case of a normal operation, the entrainment member abuts the limit stop and is, thus, moved by the limit stop when the drive movement takes place.

The entrainment member can get to the side facing away from the limit stop because of operating errors or because of tolerances which are necessary for the functioning. For example, the limit stop can be passed inadvertently when fitting the drawer. It is also possible that the drive unit is triggered unintentionally when the drawer cabinet is not yet fitted, so that upon a subsequent engagement of the drawer cabinet, the entrainment member arrives on the side facing away from the limit stop. In the case of such an undesired initial situation, it was always necessary up to now to bring the entrainment member to the right side of the limit stop with relative high force. Of course, in doing so, damages could occur in various parts of the drive device. It could even happen that the complete drive device could not be used anymore.

SUMMARY OF THE INVENTION

Therefore, the object of the present invention is to provide an improved drive device compared to the state of the art. In particular, the known disadvantages should be remedied. Especially, damages in the case of operating errors should be precluded.

Thus, it is provided according to the invention that on a side facing away from the drive limit stop, a passing ramp is provided to allow the entrainment member to pass over the drive element in the drive movement direction. This means, in contrast to previous construction, the side facing away from the limit stop is formed in such a way that moving the entrainment member back onto the right side does not cause damages anymore. The passing ramp is shaped in such a way that driving past is possible without damages. The passing ramp can also be labelled as deflecting element or as switch.

Preferably, the drive device comprises a housing, the drive element is lockable at the housing, and a force storage member force-actuating the drive element is connected on the one hand to the housing and on the other hand to the drive element. If the drive device is formed as an ejection device for a movable furniture part, the drive element is unlocked by over-pressing the movable furniture part into an over-pressing position behind the closing position of the movable furniture part, whereby the force storage member is unloaded and ejects via the drive element the movable furniture in opening direction (corresponds to the drive movement direction). Such devices can also be denoted as so-called touch-latch mechanisms. The locking can be effected frictionally engaged, form-fitting, or in a similar manner. According to a preferred embodiment, the drive element or a drive or ejection slider connected to the drive element is lockable at the housing by a heart curve-shaped sliding guide track formed in the housing or by an angled end section formed in the housing.

The drive limit stop should be formed in such a way that it allows an entrainment of the entrainment member. Preferably, the drive limit stop is oriented obliquely (i.e., at an incline), preferably rectangular (perpendicular), to the drive movement direction. Particularly preferred in operating state, the drive limit stop forms a plane which is oriented rectangular (perpendicular) to the drive movement direction and substantially vertical.

Now, in order to enable the passing of the drive element in a manner as easy and careful as possible, preferably the passing ramp has a ramp surface which is inclined preferably in an inclination angle between 10° and 45° to the drive movement direction. In operating state, the inclination angle of the ramp surface can be spanned around a vertical axis. If that is the case, the ramp surface forms a lateral limitation (so to speak "looking" to the side). This ramp surface is also averted laterally from the drive limit stop. In contrast, according to a preferred embodiment, in the operating state the inclination angle of the ramp surface is spanned around an axis oriented horizontally and rectangular to the drive movement (thereunto see for example FIG. 17). This ramp surface thus forms an "upward looking" limitation at the side averted from the drive limit stop.

Preferably, the drive element comprises a base part. For a damage-free reversible passing, preferably the drive element has a base part, and the passing ramp is supported movably on the base part. Particularly preferred, the passing ramp is pivotable or flexibly movable around an axis oriented obliquely, preferably rectangular (perpendicular), to the drive movement direction. Here, a simple embodiment provides that the base part and the passing ramp are formed in one piece, preferably made from plastic.

Basically, it is possible that the present invention is retrofitted in existing drive devices. Therefore, only the drive element ought to be replaced by a novel drive element with a passing ramp. Hence it is not necessary that the entrainment member be a mandatory part. However, preferably the entrainment member is part of the drive device and is movable relative to the drive element. The detailed construction of the entrainment member is per se arbitrary. Preferably, the entrainment member is formed bolt-shaped, and the entrainment member is oriented obliquely, preferably rectangularly, to the drive movement direction. For a corresponding arrangement of the entrainment member in the area of the drive device, the entrainment member is mounted to a base element, and the entrainment member is supported movably, preferably pivotable, around an axis oriented parallel to the drive movement direction, at the base element.

Up to now, it was already possible to move the entrainment member past various parts by force. In order to make provisions for damages, preferably either the passing ramp is movable relative to the base part of the drive element, or the entrainment member is movably supported at the base element and yields by the contact between the passing ramp and the entrainment member in the course of passing the passing ramp in a drive movement direction. This means, one of the involved components (passing ramp or entrainment member) is formed yieldingly. Damages are thereby prevented.

For a good coupling of the entrainment member with the drive element, preferably provided a catch lever for the entrainment member is arranged at the drive element, and the catch lever faces towards the drive limit stop. This catch lever is supported movably, preferably pivotable, at the drive element or at the base part of this drive element.

In order to prevent noise generation when the drive limit stops contact the entrainment member, preferably the drive limit stop is formed by a buffer element, preferably consisting of rubber.

An arrangement includes a drawer extension guide and a drive device according to the invention. Here, the drawer extension guide can comprise a carcass rail and a drawer rail, and the entrainment member is mounted to the carcass rail which forms the base element.

In principle, the drive device can be arranged at a furniture carcass of an item of furniture, and the entrainment member can be fixed to a movable furniture part. However, preferably the drive element is arranged on the movable furniture part and the entrainment member is arranged on the furniture carcass.

As already mentioned, the drive device can act as an ejection device. It is, however, also possible that the drive device acts as a, preferably damped, retraction device for retracting the movable furniture part from an open position into a closed position. Also, a variant is possible where the drive device acts both as an ejection device and as a retraction device.

BRIEF DESCRIPTION OF THE DRAWINGS

Further details and advantages of the present invention are described more fully hereinafter by the specific description with reference to the embodiments illustrated in the drawings, in which.

DETAILED DESCRIPTION OF THE INVENTION

Figure 1:
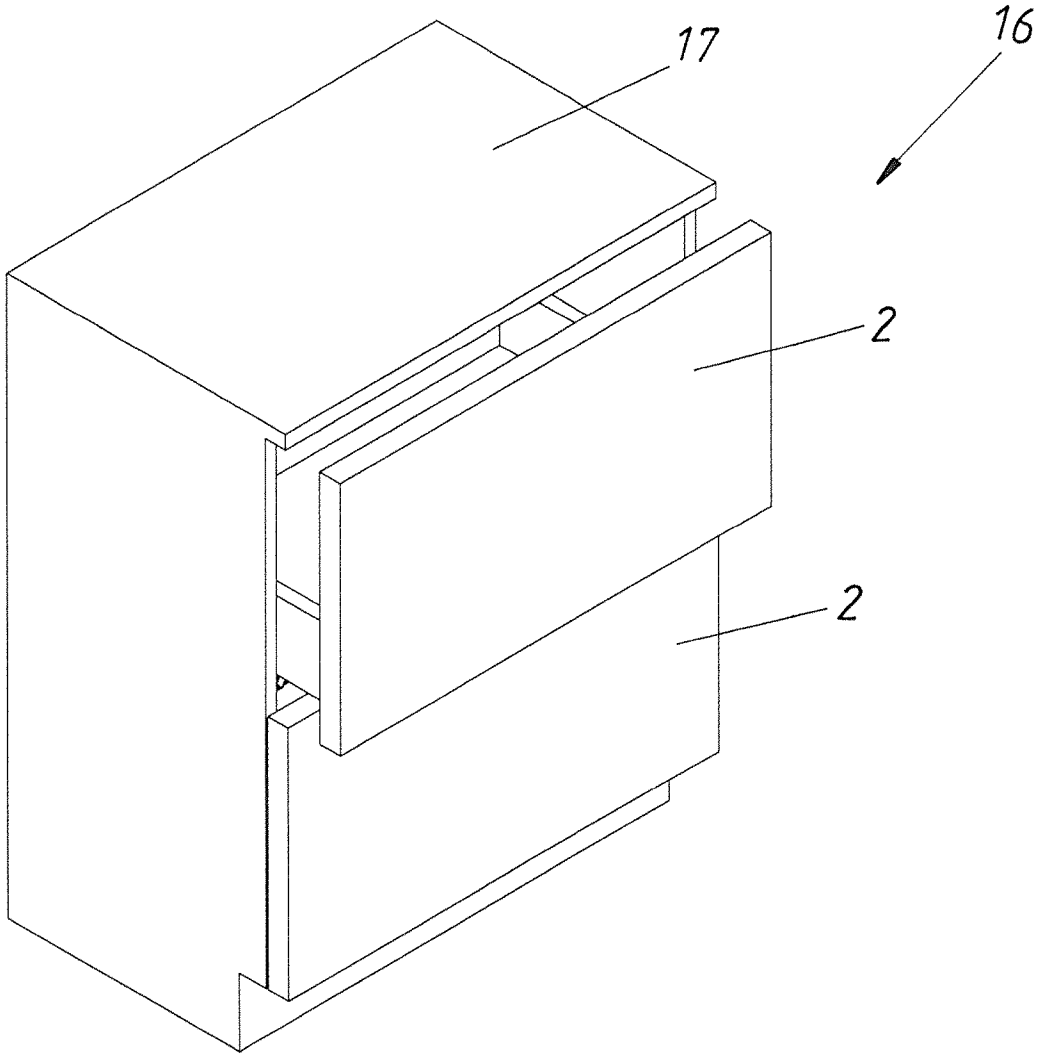
FIG. 1 is a perspective view of an item of furniture.

FIG. 1 shows an item of furniture 16 with two furniture parts 2 movably supported in the furniture carcass 17, wherein the upper movable furniture part 2 is partly opened.

Figure 2:
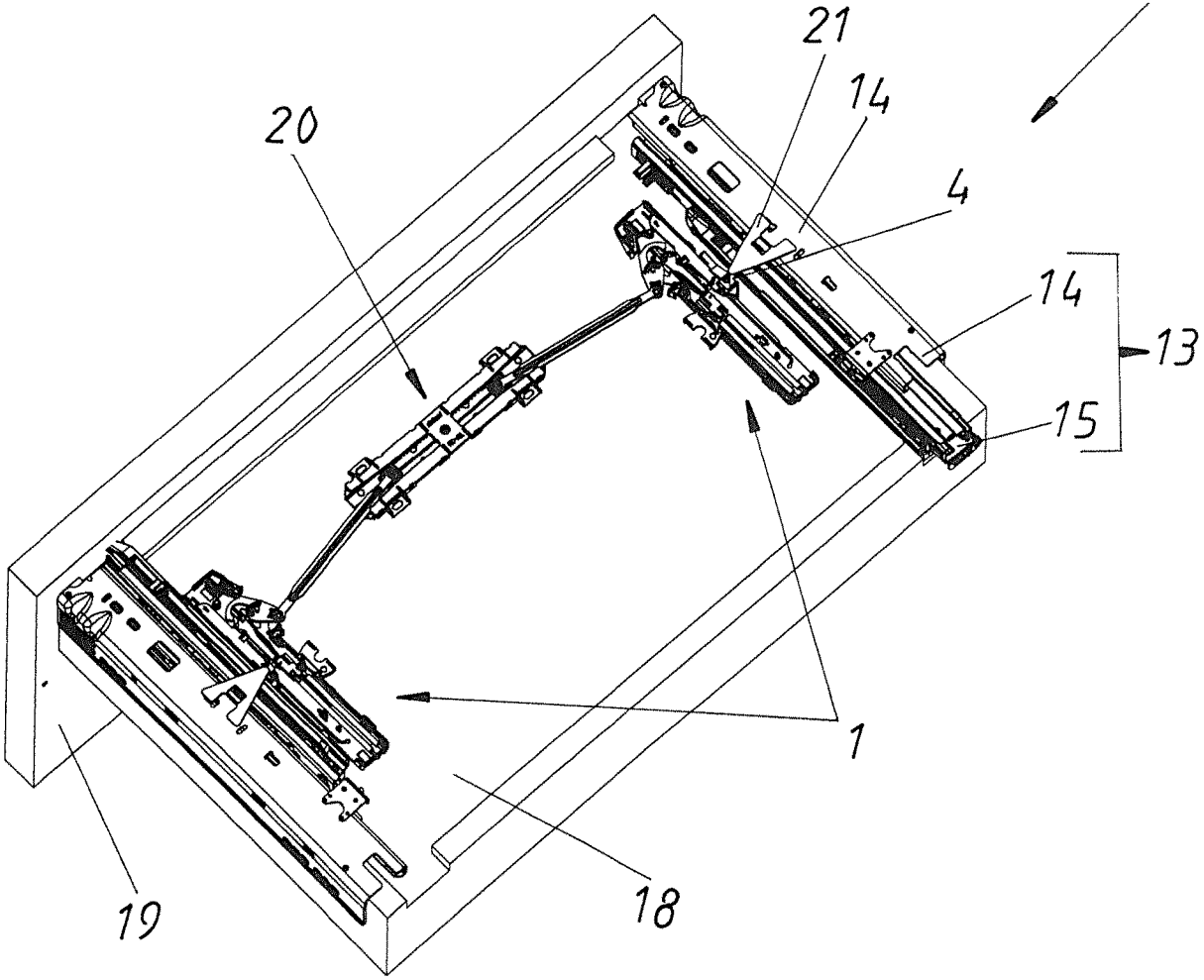
FIG. 2 is a perspective view of the bottom side of a movable furniture part with a drive device.

FIG. 2 shows the bottom side of a movable furniture part 2 with an arrangement consisting of drawer extension guides 13 arranged on both sides and drive devices 1 arranged on both sides. The movable furniture part 2 comprises a front panel 19 and a drawer container with a drawer bottom 18. The drawer extension guides 13 comprise a carcass rail 14, a drawer rail 15 and as the case may be a center rail. The entrainment member 4 is attached to the carcass rail 14 via a holding plate 21. Thus, this entrainment member 4 is fixed to the furniture carcass 17. Mirror-symmetrically formed drive devices 1 are arranged or mounted on both sides of the drawer bottom 18. Both of these drive devices 1 are synchronized with each other by a synchronizing device 20.

Figure 3:
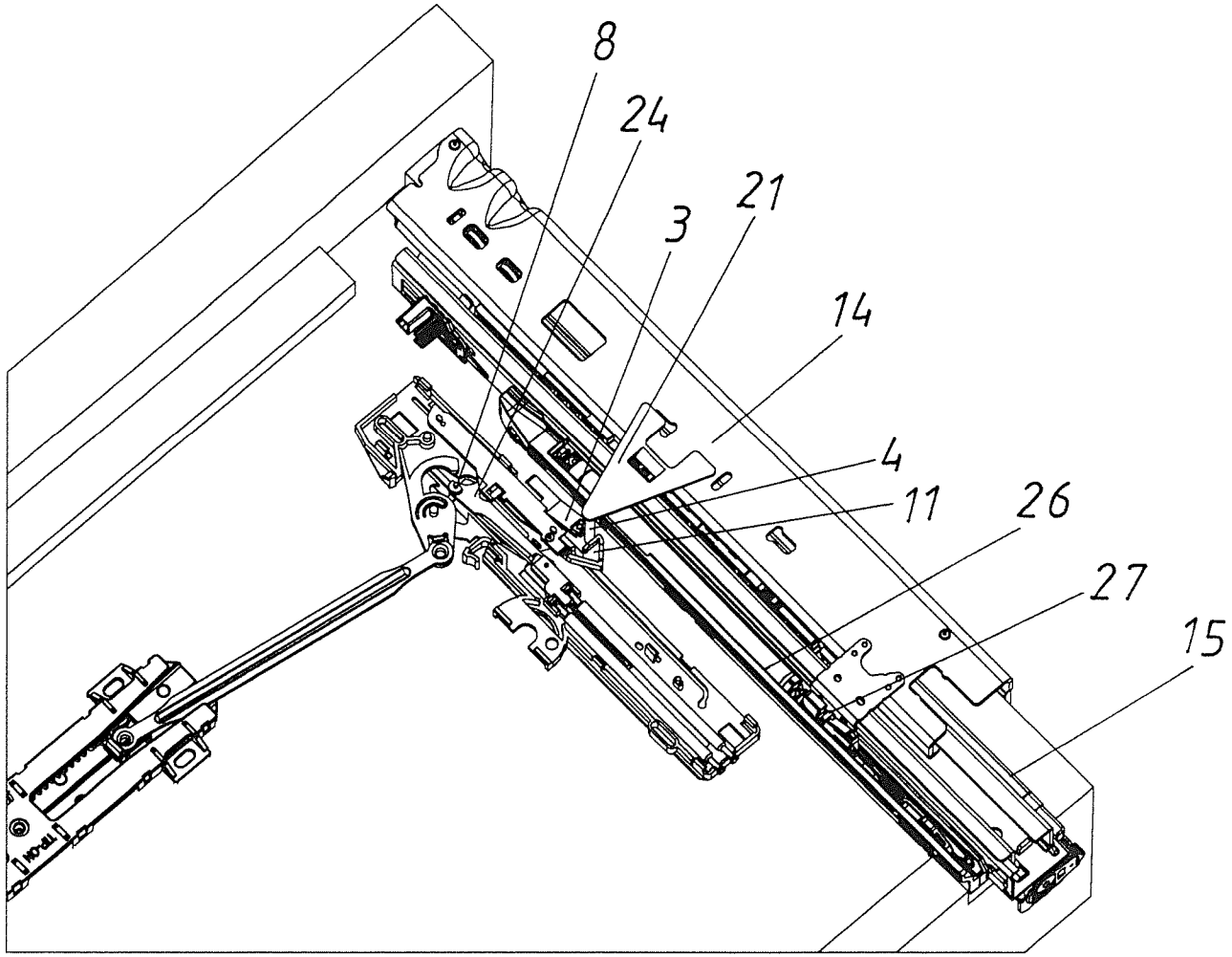
FIGS. 3-6 show various positions of the drive device with the movable furniture part.

A normal position of the drive device 1 is shown in FIG. 3. Here, the entrainment member 4 is positioned or "caught" between the drive element 3 and a catch lever 11. The drive device 1 is situated in the locking position, because the locking lever 24 is locked in the heart curve-shaped sliding guide track 8. Also a retraction device 26 mounted to the drawer rail 15 is evident in this FIG. 3. This retraction device 26 can be coupled to the retraction entrainment member 23 being separate from the entrainment member 4 and being arranged on the carcass rail 14. The retraction device 26 is relaxed according to this FIG. 3, wherefore the movable furniture part 2 is situated in a closing position.

Figure 4:
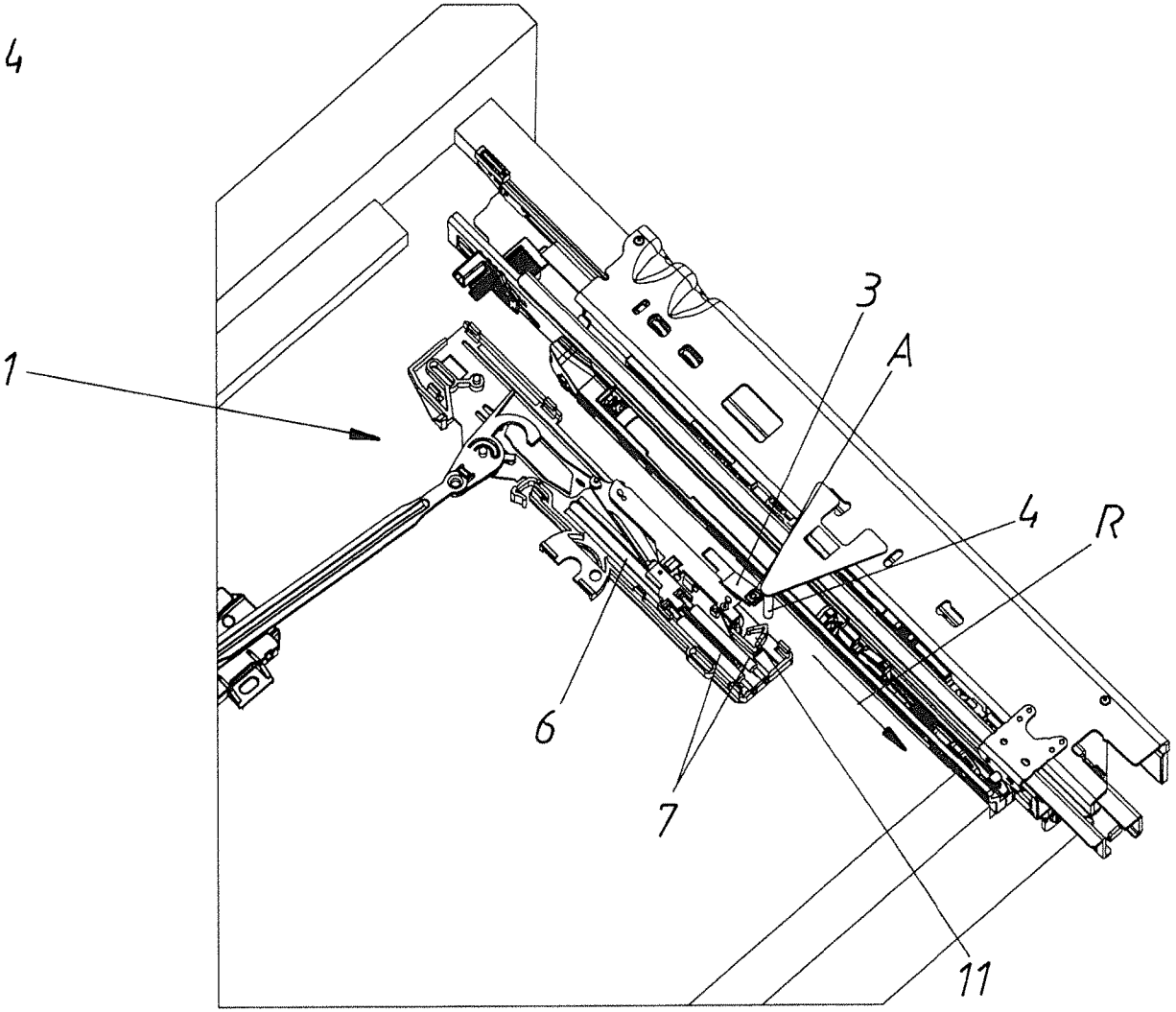

If now the movable furniture part 2 is pressed in a closing direction (thus against the drive movement direction R) starting from this closing position, unlocking of the locking lever 24 is effected, whereby the force storage member 7 of the drive device 1 can relax. Thereby, the drive element 3 is also moved in drive movement direction R relative to the housing 6 of the drive device 1. As the drive element 3 abuts the entrainment member 4 fixed to the carcass 17 via the drive limit stop A, the movable furniture part 2 repels from the entrainment member 4 fixed to the carcass via the drive device 1. Simultaneous to this opening movement, a retraction force storage member (not shown) is loaded by the coupling of the retraction device 26 with the retraction entrainment member 27. In FIG. 4, the catch lever 11 for the entrainment member 4 is already pivoted from its catch position, so that the movable furniture part 2 is situated in freewheel. For that, the catch lever 11 is supported pivotally at the base part 9 of the drive element 3. As a result of the pivoting of the catch lever 11 in this manner, a distance between the catch lever 11 and the drive limit stop A will vary, as seen through a comparison of FIGS. 3 and 4. In the course of closing the movable furniture part 2, a loading of the force storage member 7 is initially effected till the locking lever 24 is again locked. After reaching this locking position, the retraction device 26 can take effect and moves the movable furniture part 2 in the last closing section into the closed position.

Figure 5:
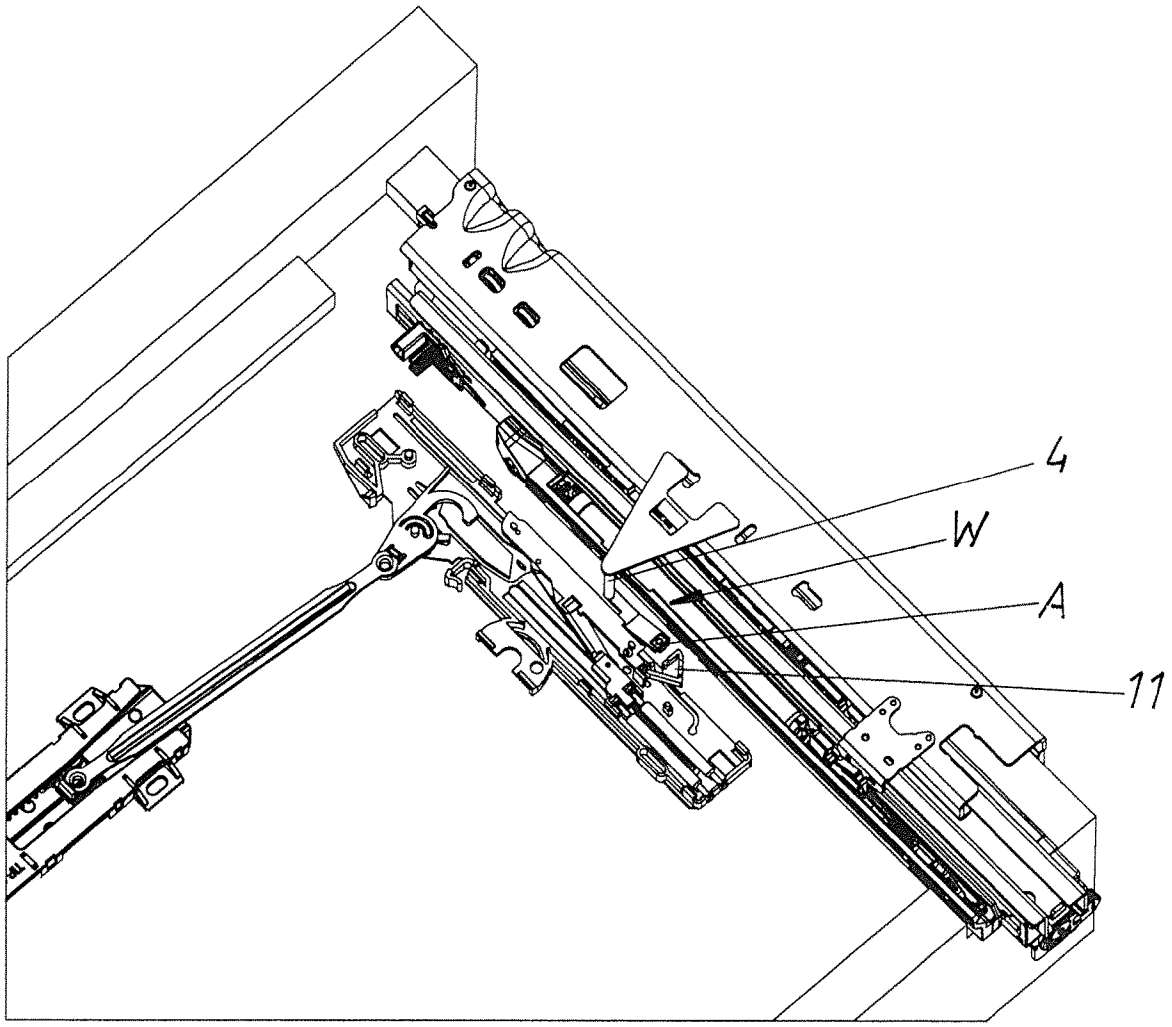

In the case of an operating error, the entrainment member 4 can get to the side W facing away from the drive limit stop A, as shown in FIG. 5. If trying to open the movable furniture part 2 starting from this false position, this cannot be done in the prescribed manner, since no repelling from the entrainment member 4 is possible. If this false position occurred up to now, force was necessary to try and bring the entrainment member 4 again to the correct side of the drive limit stop A. In doing so, of course, damages could occur.

Figure 6:
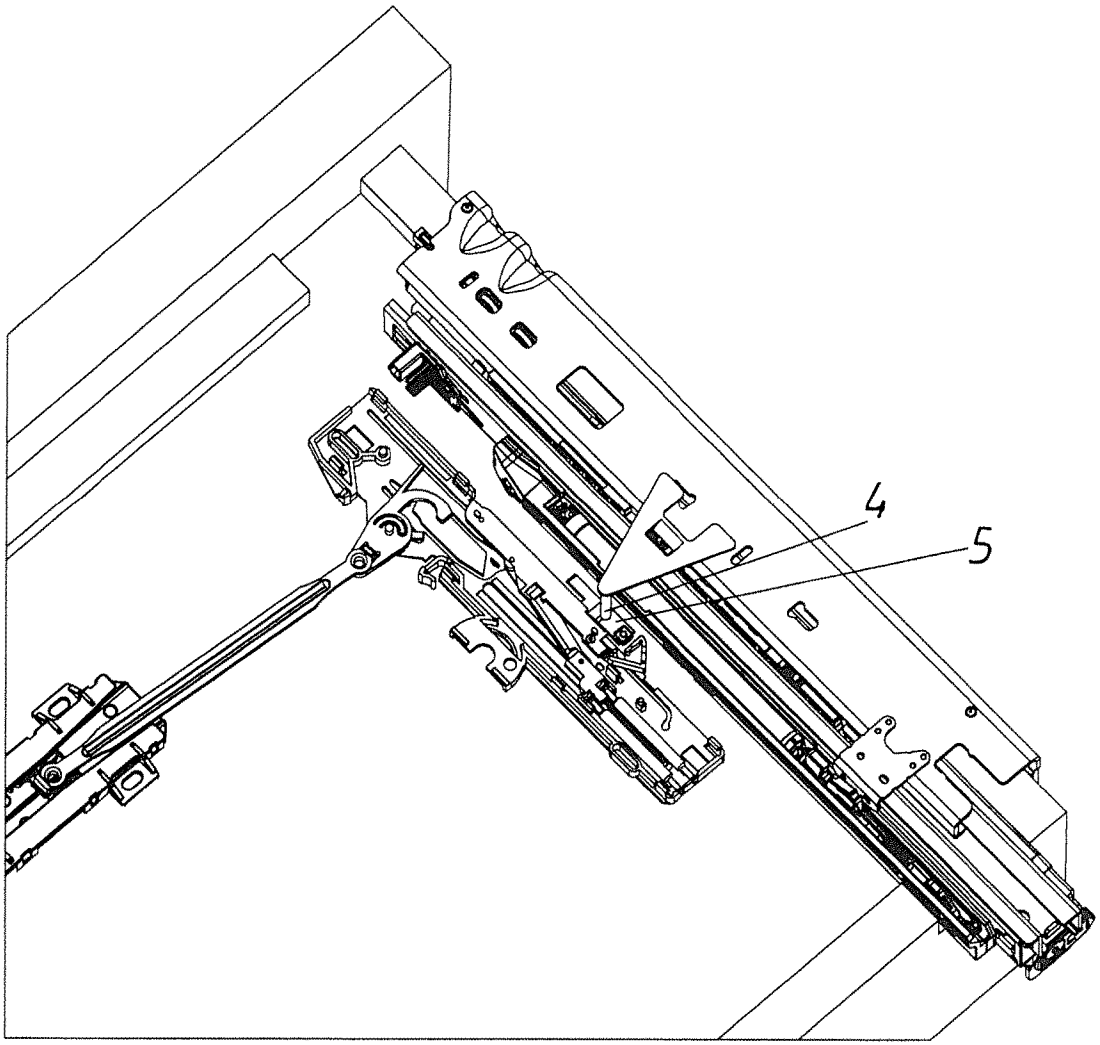

In FIG. 6 it is now evident that a passing ramp 5 is formed on the drive element 3, which passing ramp 5 enables a damage-free moving back of the entrainment member 4 to the "correct" side of the drive limit stop A facing towards the catch lever 11.

Figure 7:
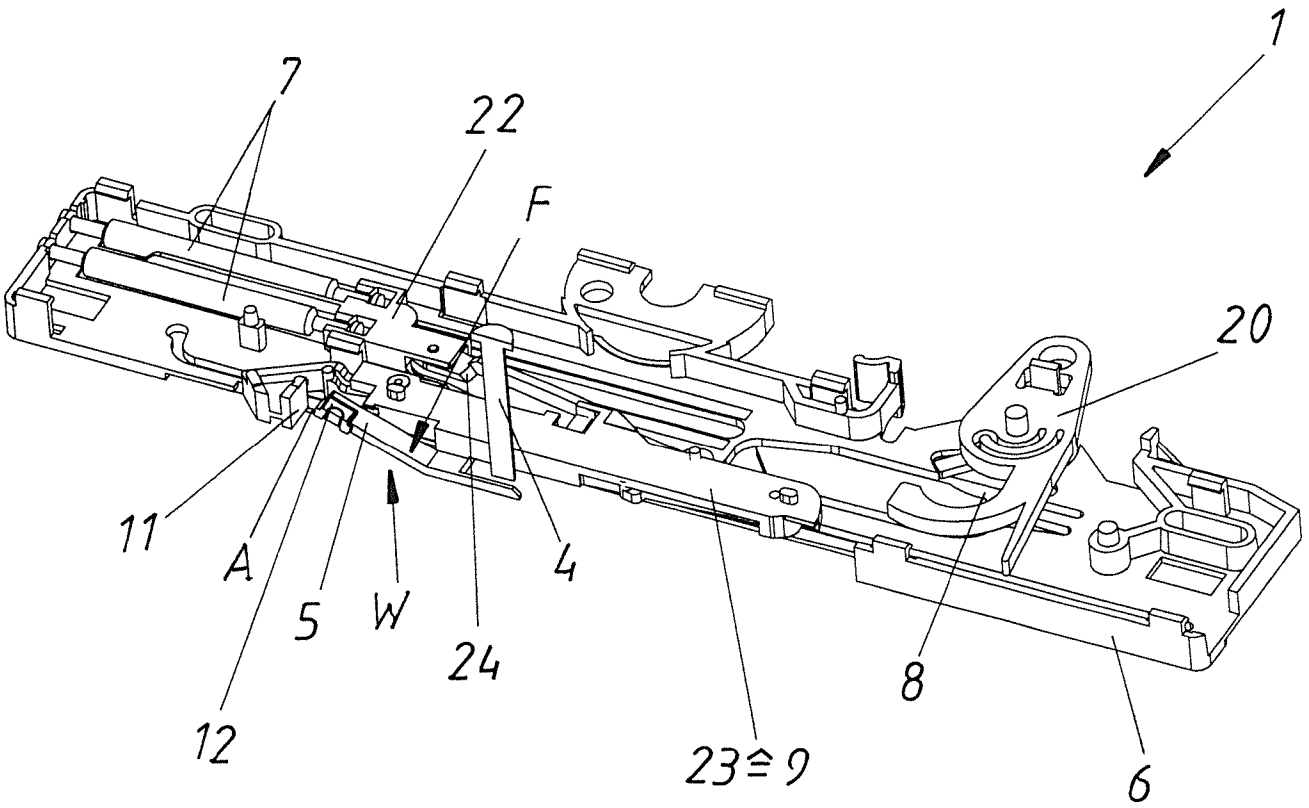
FIGS. 7-10 show various positions of the drive device without the movable furniture part.

FIG. 7 shows from another perspective the housing 6 of the drive device 1 with the diverse important components and the entrainment member 4. The position of the entrainment member 4 corresponds to the position according to FIG. 5. In this FIG. 7 the ejection slider 22 is also discernible. The force storage member 7 is held on the ejection slider 22. Moreover, the locking lever 24 is pivotally supported on this ejection slider 22. Further, the coupling element 23 is shown which forms the base part 9 of the drive element 3. The passing ramp 5 is formed in one piece with this base part 9. Also the buffer element 12 is arranged on this passing ramp 5, which buffer element 12 forms the drive limit stop A. The passing ramp 5 comprises an inclined, "upward looking" ramp surface F.

Figure 8:
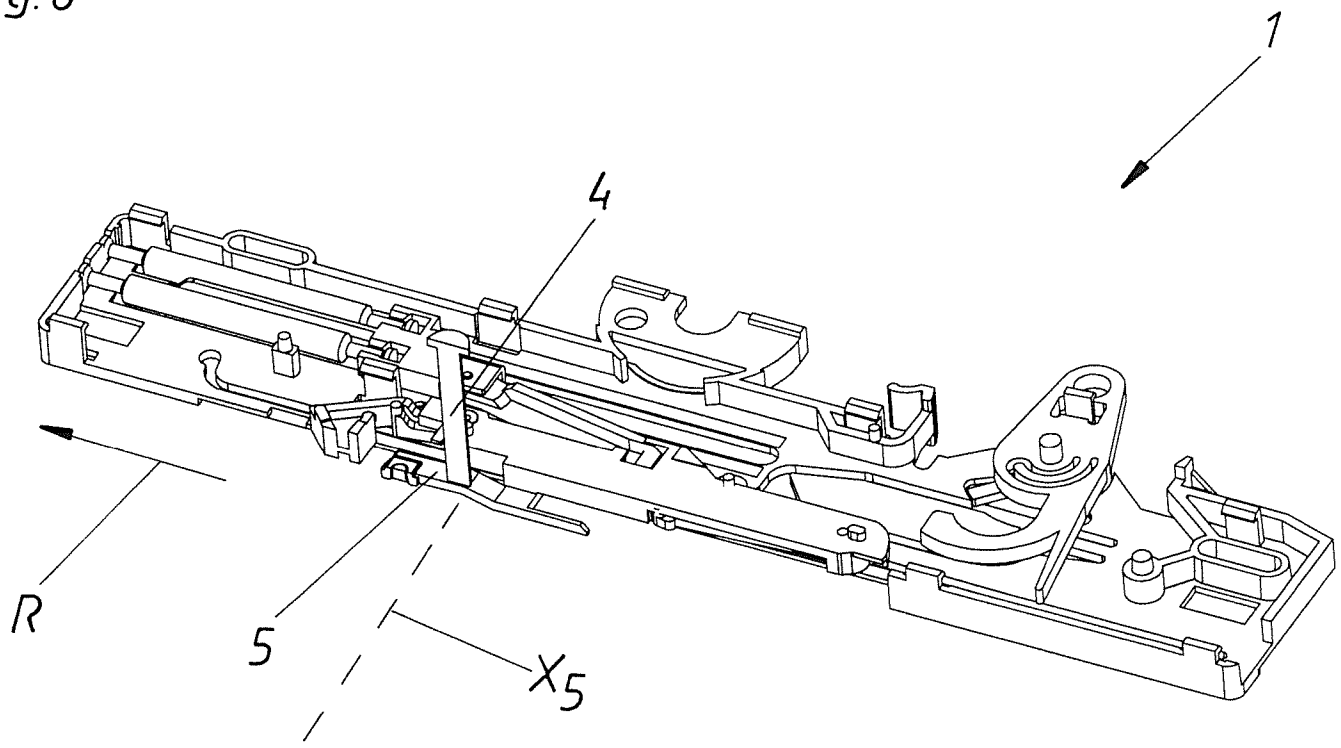

FIG. 8 corresponds to the position of the entrainment member 4 according to FIG. 6. According to FIG. 8, the entrainment member 4 is moved in drive movement direction R relative to the drive element 3. By the contact of the bolt-shaped entrainment member 4 with the inclined ramp surface F of the passing ramp 5, the front area of the passing ramp 5 is moved or pivoted about the horizontal axis $X_5$ oriented perpendicular to the drive movement direction R. This means, this passing ramp 5 yields.

Figure 9:
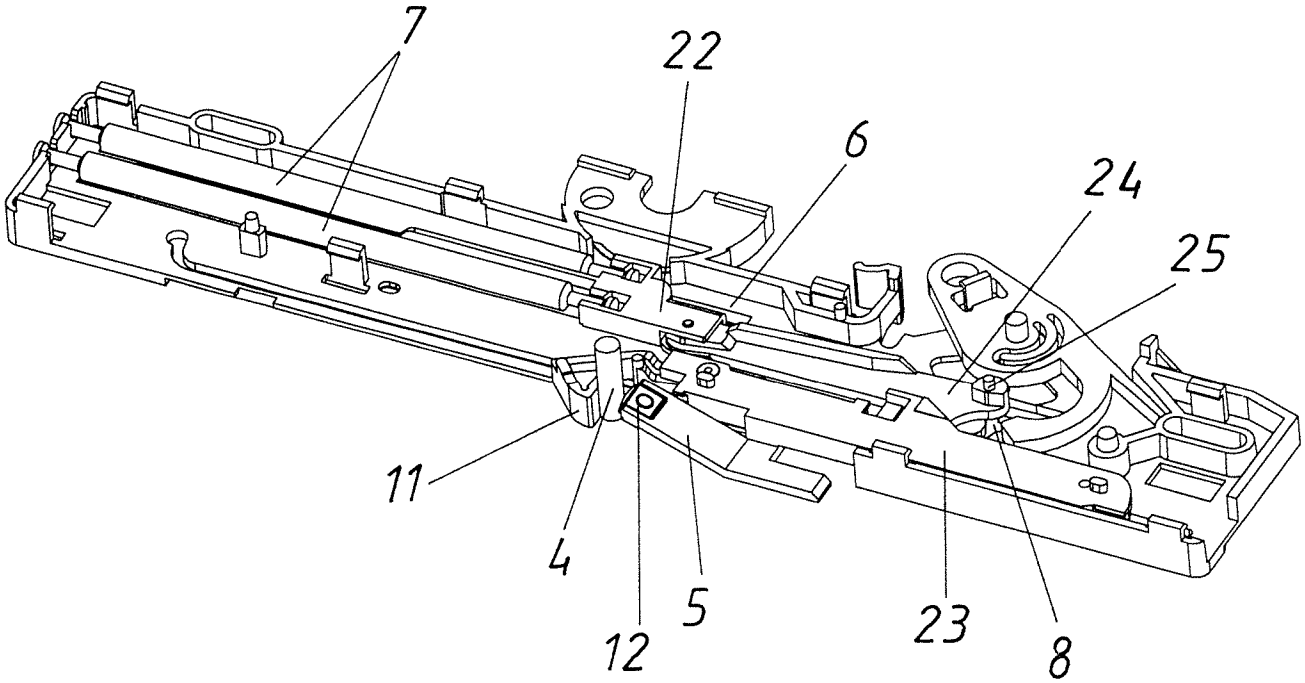

As soon as there is no more contact between the entrainment member 4 and the ramp surface F of the passing ramp 5 in the course of this relative movement in the drive movement direction R, the entrainment member 4 again reaches its coupling or catch position between the drive limit stop A and the catch lever 11 as shown in FIG. 9. In this FIG. 9, it is also evident that the locking lever 24 is locked in the heart curve-shaped sliding guide track 8 via the locking pin 25. Via a limit stop (not shown), the locking lever 24 contacts the coupling element 23 and, thus, the drive element 3. Hence, the ejection slider 22 is in connection with the drive element 3.

Figure 10:
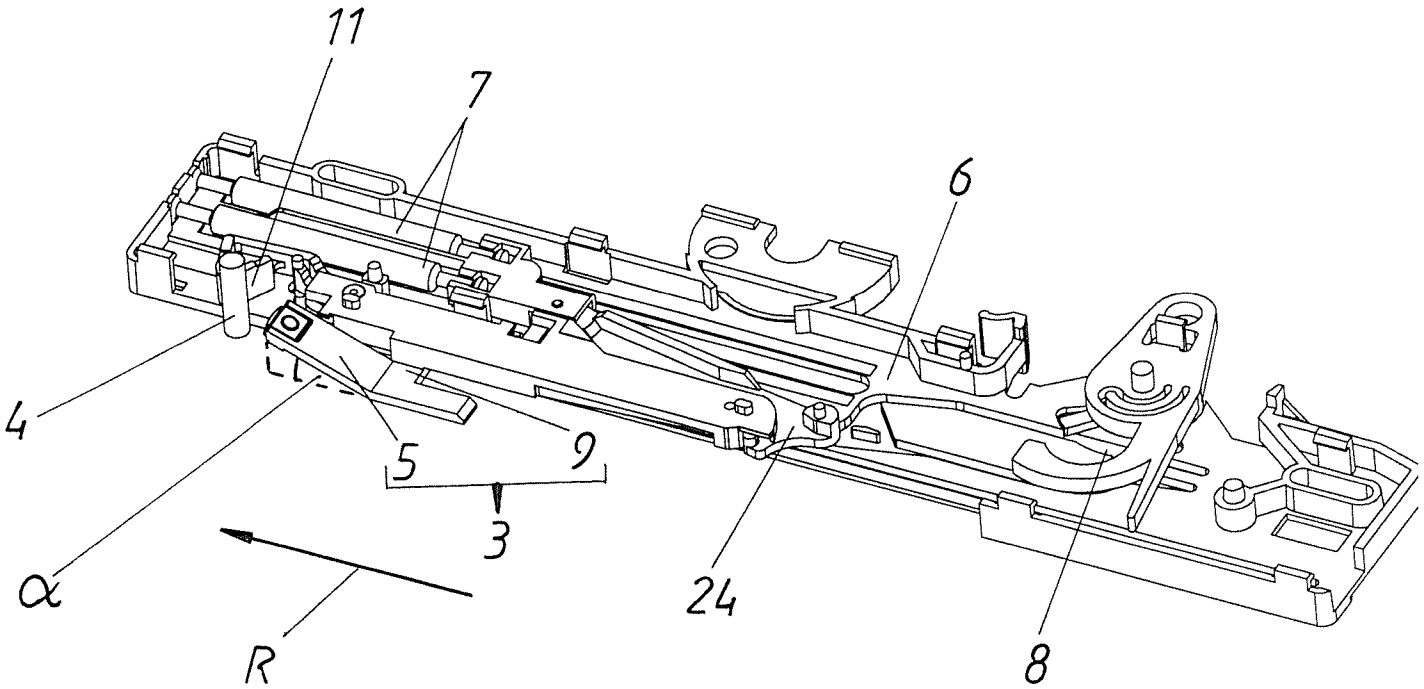
Figure 11:
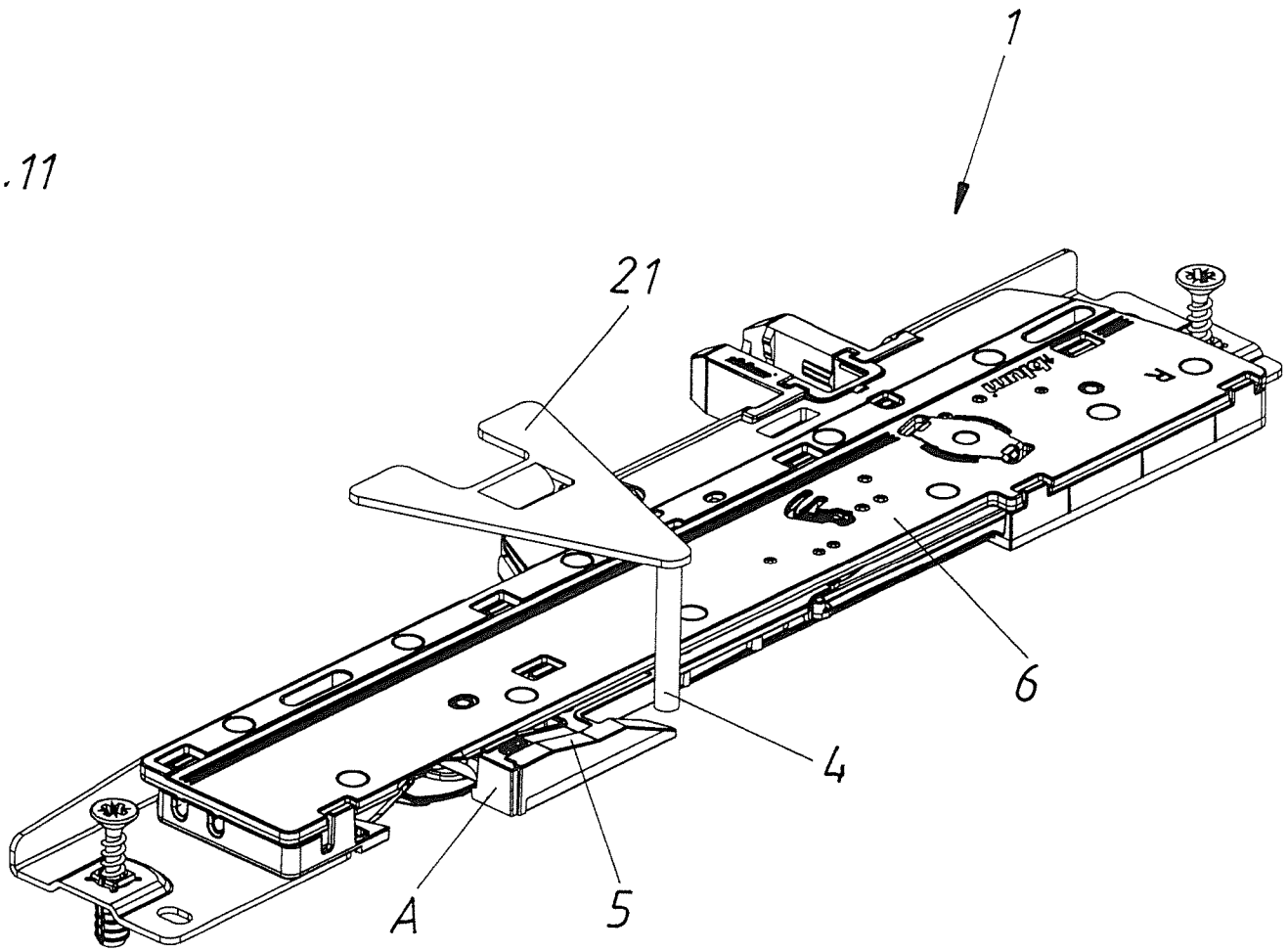
FIGS. 11-18 are various views of the drive device in the case of a movably supported entrainment member.

If according to FIG. 10 the ejection process is already finished, the movable furniture part 2 is again in freewheel, since the entrainment member 4 is not anymore held between the catch lever 11 and the drive limit stop A (corresponds to FIG. 4). The inclination angle α of the ramp surface F is indicated in FIG. 10.

The embodiments previously shown in the figures each concern a flexible implementation of the passing ramp 5 itself. As shown in FIGS. 11 to 18, however, the passing ramp 5 can also be formed mechanically stable, and the entrainment member 4 is instead supported yieldingly on a base element 10 (carcass rail 14). According to FIG. 11, only the holding plate 21 and the entrainment member 4 (without the carcass rail 14) is shown. The passing ramp 5 is arranged on the averted side W of the drive limit stop A. The passing ramp 5 comprises two different inclination sections in the area of the ramp surface F.

Figure 12:
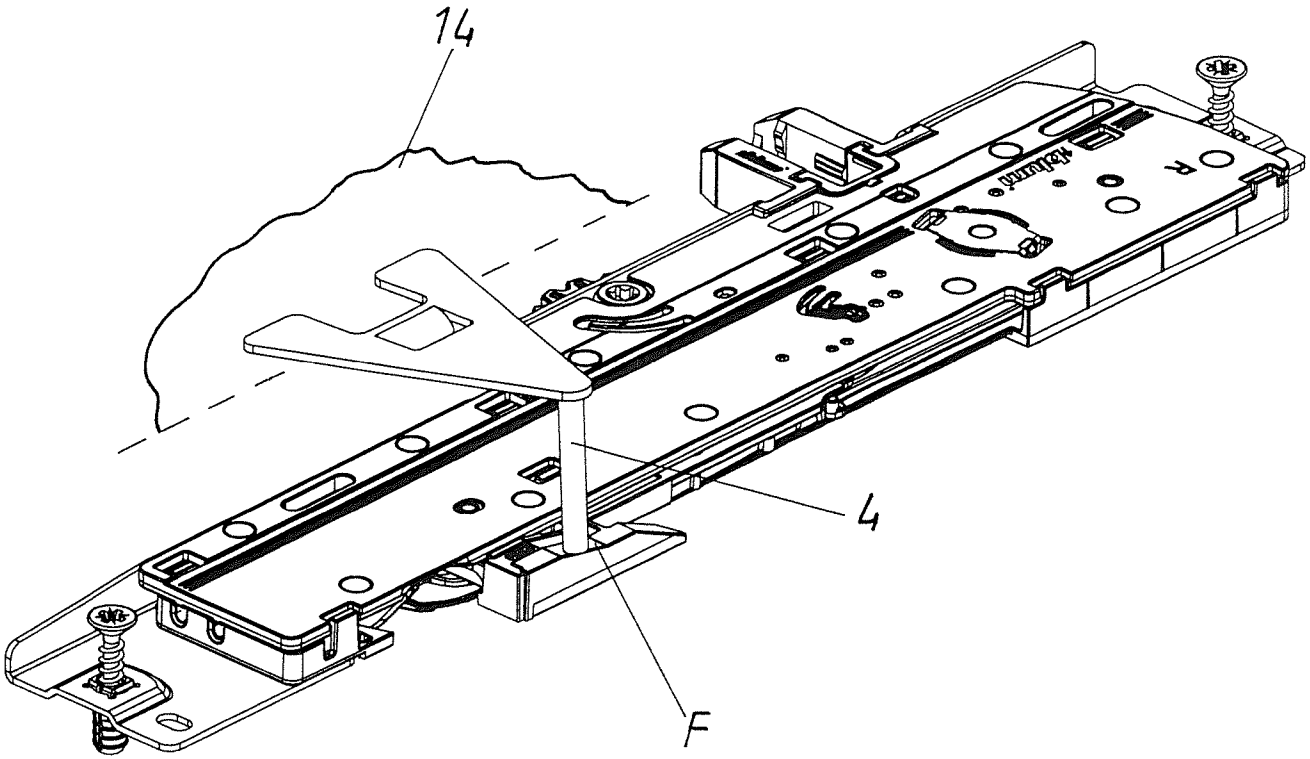

In FIG. 12 also the carcass rail 14 is graphically indicated. Additionally, it is evident that the entrainment member 4 already contacts the central area of the ramp surface F.

Figure 13:
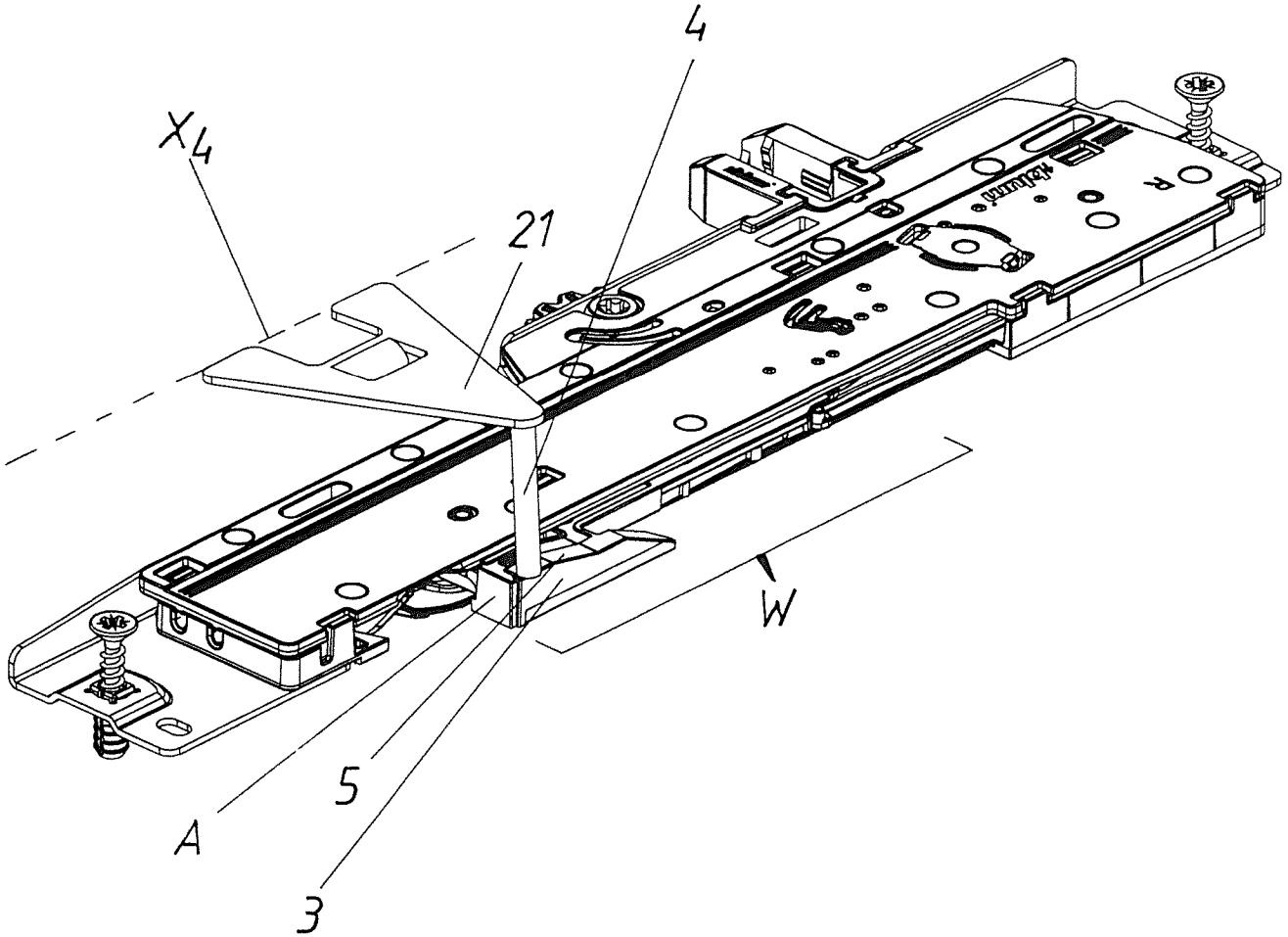

In the course of the movement of the entrainment member 4 in the drive movement direction R along the passing ramp 5, the entrainment member 4 together with the holding plate 21 is pivoted about the axis $X_4$ oriented parallel to the drive movement direction R (see FIG. 13).

Figure 14:
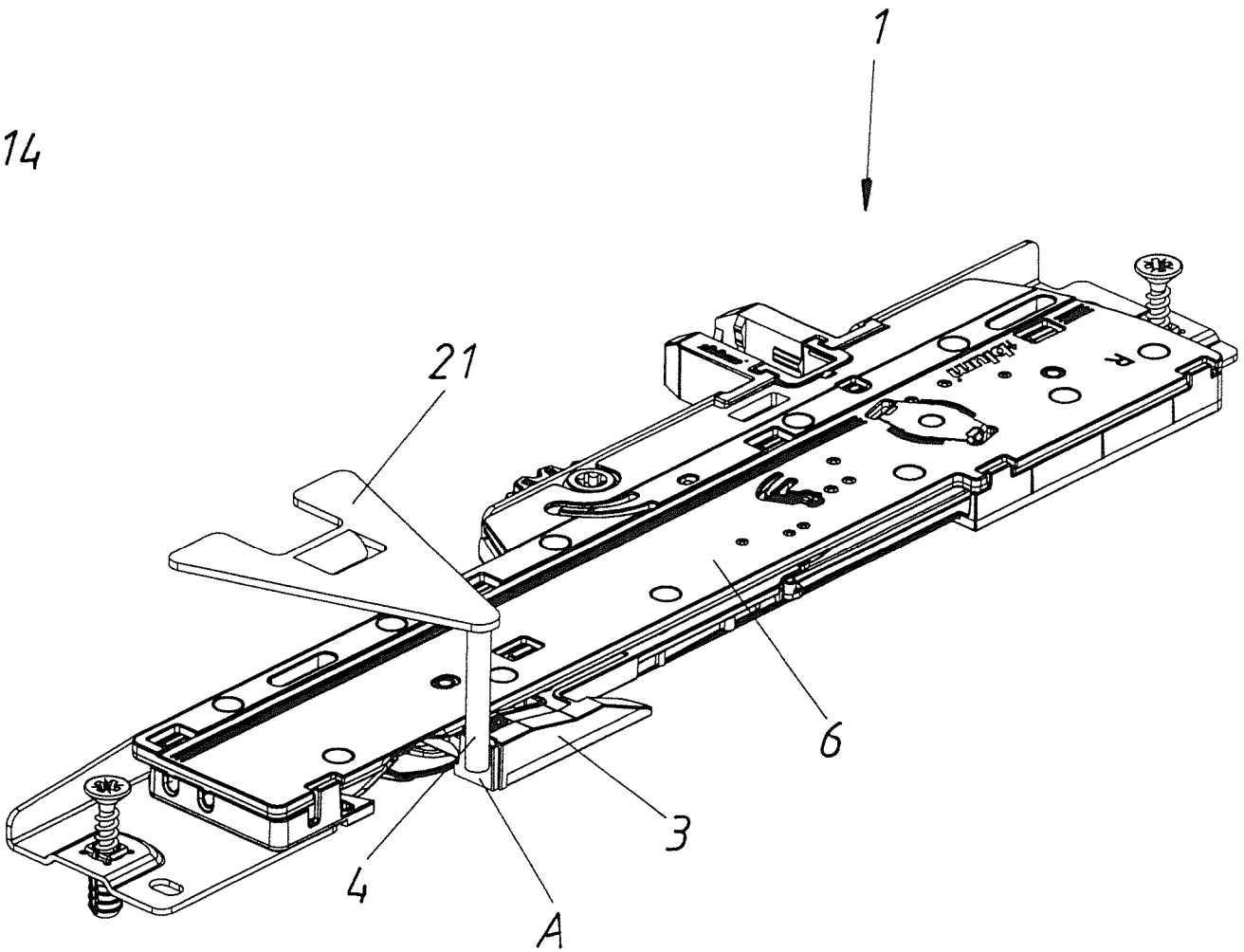

Thereby, the entrainment member 4 reaches damage-free its normal position according to FIG. 14.

Figure 15:
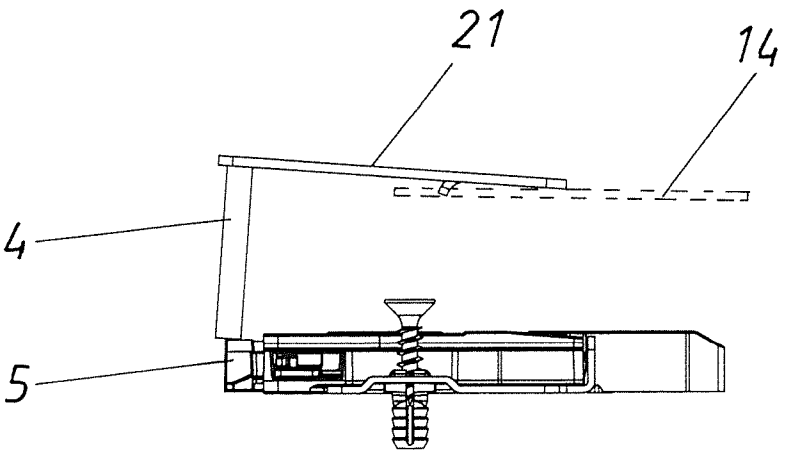

FIG. 15 shows in a cross section how the entrainment member 4 together with its holding plate 21 is pivoted in the course of passing the passing ramp 5 relative to the carcass rail 14. The reversible flexibility of the holding plate 21 can be reached by a corresponding bearing via a pivot axis, wherein the holding plate 21 can be pivoted relative to the carcass rail 14 about this pivot axis against a force actuation (for example against a leg spring not shown) into the position according to FIG. 15. Alternatively, the holding plate 21 itself can also be formed yieldingly or elastically. The yieldingness, however, can also be present in the case of a holding plate 21 firmly attached to the carcass rail 14, as the carcass rail 14 pivots or twists relative to the drawer rail 15. This twisting is particularly possible because there is play between the carcass rail 14 and the drawer 15 (for example via rolling carriages etc.).

Figure 16:
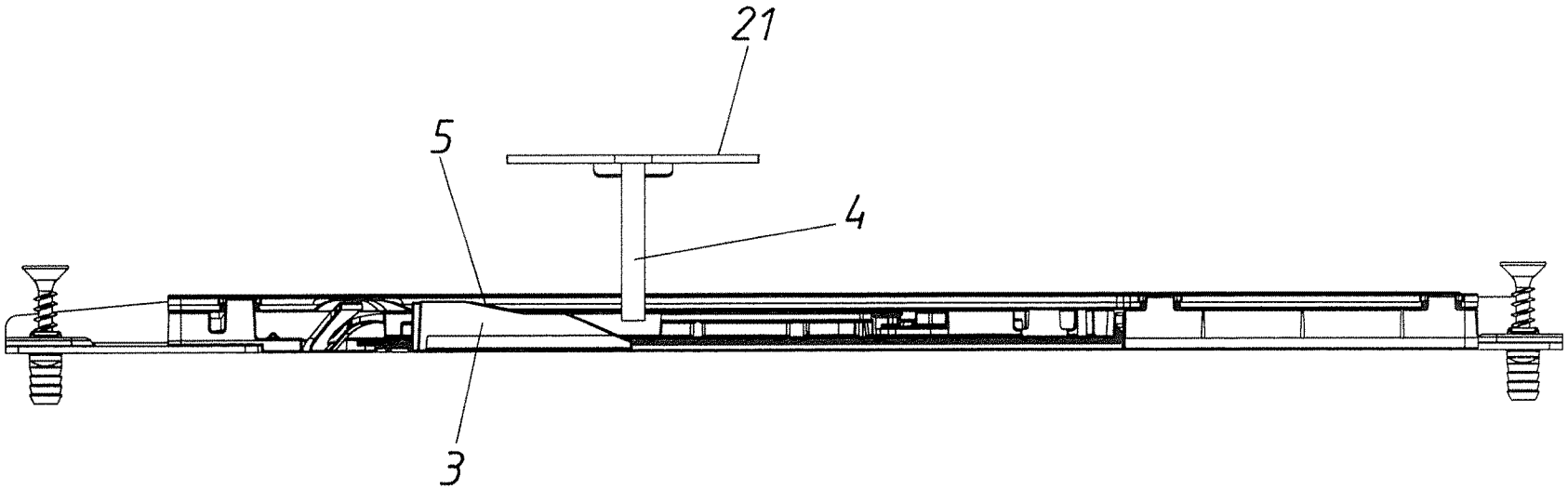
Figure 17:
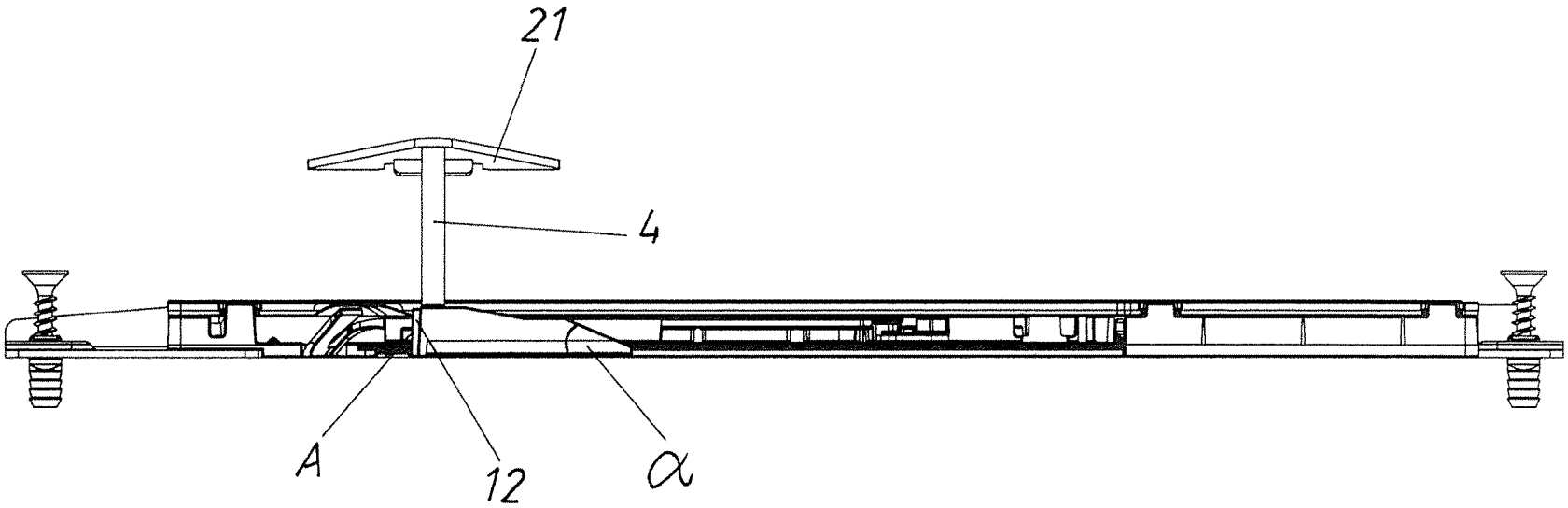
Figure 18:
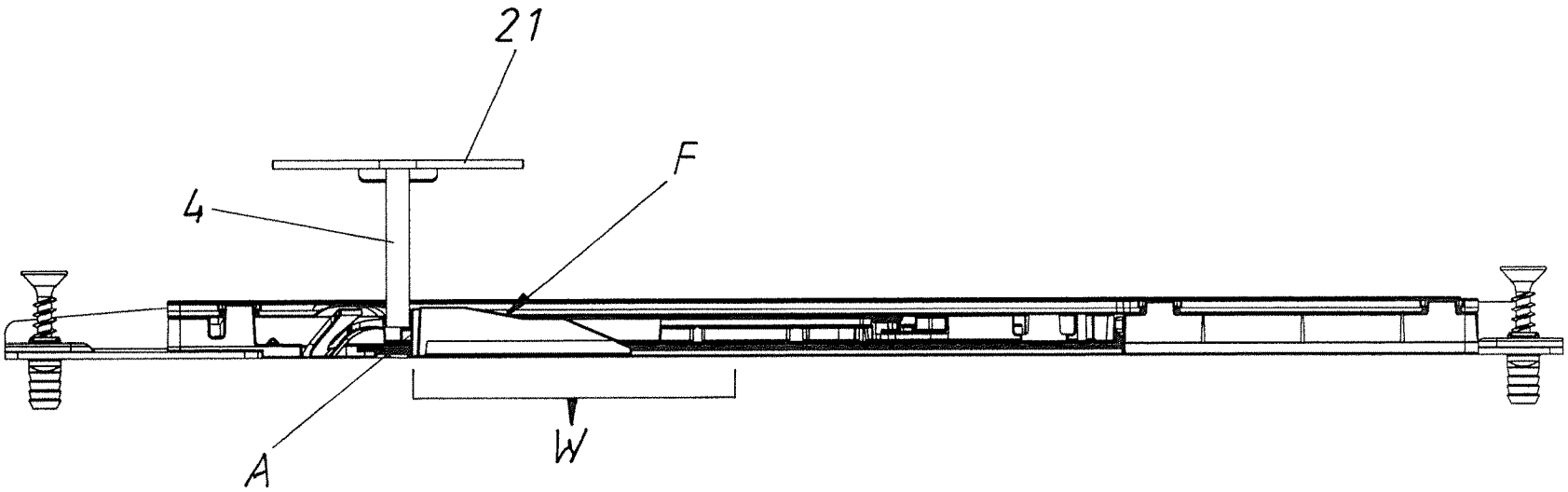

In the lateral views of FIGS. 16 to 18, the development of the ramp surface F with the different inclination angles α is well recognizable. In FIG. 17, it is also evident how the entrainment member 4 together with the holding plate 21 pivots upwards.

With the present invention, thus, a possibility is created, where in the case of an operating error, an entrainment member 4 is brought damage-free again into the position where the entrainment member 4 can be actuated by the drive limit stop A. This is enabled in a simple manner particularly in that a passing ramp 5 for the entrainment member 4 is arranged on the drive element 3, and either the passing ramp 5 or the entrainment member 4 itself is supported yieldingly.

LIST OF REFERENCE SIGNS

1 drive device
2 movable furniture part
3 drive element
4 entrainment member
5 passing ramp
6 housing
7 force storage member
8 sliding guide track
9 base part
10 base element
11 catch lever
12 buffer element
13 drawer extension guide
14 carcass rail
15 drawer rail
16 item of furniture
17 furniture carcass
18 drawer bottom
19 front panel
20 synchronizing device
21 holding plate
22 ejection slider
23 coupling element
24 locking lever
25 locking pin
26 retraction device
27 retraction entrainment member
R drive movement direction
A drive limit stop
W averted side
α inclination angle
$X_5$ axis for ramp
$X_4$ axis for entrainment member

The invention claimed is:

1. A drive device for moving a movable furniture part, the drive device comprising:

an entrainment member configured to be mounted to one of a furniture carcass and the movable furniture part;

a force-actuated drive element configured to be mounted to the other one of the furniture carcass and the movable furniture part so as to be movable in a drive movement direction, the drive element having a drive limit stop by which the entrainment member is moved during a drive movement in the drive movement direction, and the drive element including a passing ramp on a side facing away from the drive limit stop, the passing ramp being configured to allow the entrainment member to pass over the drive element in the drive movement direction; and a catch lever for catching the entrainment member, the catch lever facing towards the drive limit stop such that the entrainment member is configured to be positioned between the drive limit stop and the catch lever during the drive movement in the drive movement direction, and the catch lever being pivotably supported on a base part of the drive element such that a distance between the catch lever and the drive limit stop changes as the catch lever is pivoted.

2. The drive device according to claim 1, further comprising:

a housing, the drive element being lockable at the housing; and a force storage member configured to force-actuate the drive element, the force storage member being connected on a first end to the housing and on a second end to the drive element.

3. The drive device according to claim 2, wherein the drive element is lockable at the housing by a heart curve-shaped sliding guide track formed in the housing or by an angled end section formed in the housing.

4. The drive device according to claim 1, wherein the drive limit stop is oriented at an incline relative to the drive movement direction.

5. The drive device according to claim 4, wherein the drive limit stop is perpendicular to the drive movement direction.

6. The drive device according to claim 1, wherein the passing ramp has a ramp surface which is inclined at an inclination angle between 10° and 45° relative to the drive movement direction.

7. The drive device according to claim 1, wherein the passing ramp is movably supported on the base part.

8. The drive device according to claim 7, wherein the passing ramp is pivotable or flexibly movable around an axis oriented at an incline relative to the drive movement direction.

9. The drive device according to claim 8, wherein the axis of the passing ramp is perpendicular to the drive movement direction.

10. The drive device according to claim 7, wherein the base part and the passing ramp are formed in one piece from plastic to have a one-piece construction.

11. The drive device according to claim 7, wherein either one of (i) the passing ramp is movable relative to the base part of the drive element, or (ii) the entrainment member is movably supported at the base element, such that the passing ramp and the entrainment member move relative to each other upon contact between the passing ramp and the entrainment member during passing of the passing ramp in drive movement direction.

12. The drive device according to claim 1, wherein the entrainment member is movable relative to the drive element.

13. The drive device according to claim 12, wherein the entrainment member is bolt-shaped.

14. The drive device according to claim 12, wherein the entrainment member is oriented at an incline relative to the drive movement direction.

15. The drive device according to claim 14, wherein the entrainment member is perpendicular to the drive movement direction.

16. The drive device according to claim 12, wherein the entrainment member is mounted to a base element.

17. The drive device according to claim 16, wherein the entrainment member is supported movably at the base element.

18. The drive device according to claim 17, wherein the entrainment member is pivotable around an axis parallel to the drive movement direction.

19. The drive device according to claim 1, wherein the drive limit stop is formed by a buffer element.

20. The drive device according to claim 19, wherein the drive limit stop is formed of rubber.

21. An arrangement comprising:

a drawer extension guide; and the drive device according to claim 1.

22. The arrangement according to claim 21, wherein the drawer extension guide comprises a carcass rail and a drawer rail, and the entrainment member is mounted to the carcass rail forming a base element.

23. An item of furniture comprising:

a furniture carcass;

a movable furniture part; and the drive device according to claim 1.

24. The item of furniture according to claim 23, wherein the drive element is arranged on the movable furniture part and the entrainment member is arranged on the furniture carcass.

25. The item of furniture according to claim 23, wherein the drive device acts as an ejection device or as a retraction device for the movable furniture part.

* * * * *